US011548138B2

(12) United States Patent
Woidasky

(10) Patent No.: US 11,548,138 B2
(45) Date of Patent: Jan. 10, 2023

(54) TOOL STORAGE DEVICE FOR A MACHINE TOOL, AND MACHINE TOOL

(71) Applicant: Bystronic Laser AG, Niederönz (CH)

(72) Inventor: Lars Woidasky, Gotha (DE)

(73) Assignee: Bystronic Laser AG, Niederönz (CH)

( * ) Notice: Subject to any disclaimer, the term of this patent is extended or adjusted under 35 U.S.C. 154(b) by 0 days.

(21) Appl. No.: 17/052,931

(22) PCT Filed: May 7, 2019

(86) PCT No.: PCT/EP2019/000145

§ 371 (c)(1),
(2) Date: Nov. 4, 2020

(87) PCT Pub. No.: WO2019/214843

PCT Pub. Date: Nov. 14, 2019

(65) Prior Publication Data

US 2021/0245226 A1 Aug. 12, 2021

(30) Foreign Application Priority Data

May 8, 2018 (DE) ..... 10 2018 110 955.5

(51) Int. Cl.

| | |
|---|---|
| ***B21D 5/02*** | (2006.01) |
| ***B21D 37/04*** | (2006.01) |
| ***B25H 3/04*** | (2006.01) |
| ***B21D 37/14*** | (2006.01) |

(52) U.S. Cl.

CPC ..... *B25H 3/04* (2013.01); *B21D 5/0254* (2013.01); *B21D 37/04* (2013.01); *B21D 37/145* (2013.01)

(58) Field of Classification Search

CPC ..... B25H 3/04; B21D 5/0254; B21D 37/145; B21D 37/04

See application file for complete search history.

(56) References Cited

U.S. PATENT DOCUMENTS

| | | | | |
|---|---|---|---|---|
| 4,872,249 | A * | 10/1989 | VanderPol | B23D 45/027 29/890.031 |
| 7,210,328 | B2 * | 5/2007 | Strasser | B21D 5/02 72/20.1 |
| 8,622,212 | B2 * | 1/2014 | Kinskey | B25H 3/021 206/372 |
| 9,247,810 | B2 * | 2/2016 | Metzler | A47B 88/427 |
| 10,532,388 | B2 * | 1/2020 | Seibert | B21D 37/145 |
| 2006/0179913 | A1 * | 8/2006 | Strasser | B21D 5/02 72/420 |

(Continued)

FOREIGN PATENT DOCUMENTS

| | | |
|---|---|---|
| DE | 202005004407 U1 | 5/2005 |
| DE | 202005004407 | 6/2005 |

(Continued)

OTHER PUBLICATIONS

International Search Report for Priority Document WO201914843.

(Continued)

*Primary Examiner* — Kimberley S Wright
(74) *Attorney, Agent, or Firm* — Jacob Eisenberg

(57) ABSTRACT

The disclosure relates to a tool storage device for a machine tool having a tool storage unit which can be mounted and displaced on a guide rail of the machine tool and is further designed to receive non-mounted tools for the machine tool.

14 Claims, 7 Drawing Sheets

(56) References Cited

U.S. PATENT DOCUMENTS

| | | | | |
|---|---|---|---|---|
| 2009/0145789 | A1* | 6/2009 | Panosian | B25H 3/00 206/373 |
| 2009/0145866 | A1* | 6/2009 | Panosian | B25H 3/04 211/85.15 |
| 2011/0121699 | A1* | 5/2011 | Freimuth | B25H 3/028 312/237 |
| 2012/0305550 | A1* | 12/2012 | Nickley | B25H 3/00 220/9.2 |
| 2014/0038799 | A1* | 2/2014 | Klinkhammer | B23Q 3/1556 483/1 |
| 2014/0121084 | A1* | 5/2014 | Klinkhammer | B21D 37/145 483/1 |
| 2014/0265789 | A1* | 9/2014 | Metzler | A47B 57/045 312/334.1 |
| 2017/0297074 | A1* | 10/2017 | Seibert | B21D 37/147 |
| 2020/0001340 | A1* | 1/2020 | Badegruber | B21D 37/145 |
| 2021/0129205 | A1* | 5/2021 | Gruber | B21D 37/145 |

FOREIGN PATENT DOCUMENTS

| | | | |
|---|---|---|---|
| DE | 202014007901 | U1 | 1/2016 |
| DE | 202014007901 | | 2/2016 |
| EP | 2719476 | A1 | 4/2014 |

OTHER PUBLICATIONS

Written Opinion for Priority Document WO201914843.
Translation of International Search Report for Priority Document WO201914843.
Translation of DE202005004407.
Translation of DE202014007901.
English Language Translation of DE202014007901U1.
English Language Translation of DE202005004407U1.

* cited by examiner

TOOL STORAGE DEVICE FOR A MACHINE TOOL, AND MACHINE TOOL

CROSS REFERENCE TO RELATED APPLICATIONS

This application is a national phase application of International Application No. PCT/EP2019/000145, filed on May 7, 2019, and claims the priority benefit of German Patent Application 102018110955.5, filed on May 8, 2018, the content of both of which is incorporated herein by reference.

FIELD OF THE INVENTION

The present disclosure relates to a machine tool having a tool storage device. In particular, the present disclosure relates to a machine tool having a tool storage device according to claim 1.

A machine tool is used to manufacture and machine workpieces using tools. For example, sheet metal working machines, in particular bending machines or presses such as press brakes are considered to be machine tools here. The interchangeable tools are usually fixed in a tool holder by means of a clamp.

BACKGROUND

With press brakes in particular, a high degree of flexibility is often achieved with the use of many different tools. These are typically stored in tool cabinets in the immediate vicinity of one or more machines or centrally. The basic idea is a structured and tidy production area, in which tools that are not required are put away again.

In practice, however, frequently used tools are stored everywhere, for example on bending aids or support arms, which can then no longer be used. Frequently used tools are also deposited on company-specific supply trolleys and tables, or they are pushed aside within the tool clamp. The operator tries to keep the tools within reach and save themselves additional trips. Most of the time, however, it creates disorder, which can lead to various dangerous situations. In addition, the use of bending aids and/or support arms is restricted or even made impossible.

DE 20 2014 007901 U1 discloses a bending press having a pull-out drawer for tools. The drawer is arranged next to the lower beam or upper beam.

FIELD OF THE INVENTION

An object of the present disclosure is to avoid the disadvantages of the prior art and to provide an improved tool storage device. Another object is to provide an improved machine tool.

The machine tool according to the invention, in particular a press brake, comprises a receptacle for a tool, a guide rail and at least one tool storage device having a displaceably mountable tool storage unit designed for receiving non-mounted tools for the machine tool, wherein the guide rail is arranged on a front face of the machine tool in the region of a lower beam.

The machine tool according to the present disclosure offers the advantage that non-mounted tools can be stored simply and safely without the safety or the operation of the machine tool being restricted.

It can be provided that the tool storage unit has a carriage that is moveable on the guide rail and a module carrier arranged thereon for receiving the tools. The movable carriage is fastened to the rail and can thus be moved on the machine in the same way as support arms, bending aids or the like. The movable carriage has the same guiding carriage as other add-on parts, which means that their arrangement can be exchanged. The module carrier is preferably hung on the carriage. The module carrier can be fixed with a quick clamp, for example. The module carrier is used to receive various other add-on parts. The module carrier with its parts can be individually transported, stored, equipped with tools and similarly made available flexibly. It can be exchanged between two or more machines. It does not matter whether there is a carriage there or not.

It can be provided that at least one pocket for receiving tools is provided on the module carrier. The pocket can have a solid contour, for example made of metal or plastic, or it can be designed as a bag made of a flexible material. Accordingly, tool bags can be attached to both sides of the module carrier in order to be able to receive additional punches and dies. These bags are preferably made of durable material, such as synthetic fibers—for example polyamide—or other types of fabrics. The fabrics are sew able and can therefore be flexibly adapted to various requirements. The production of the tool bag is accordingly inexpensive. Particularly stressed areas, such as the undersides of the pockets, can be reinforced with steel inserts. In addition, plug-in inserts are used as lower tool supports. This allows different tool lengths to be received. Straps can be attached on the bags at optimally distributed points, which fix the tools variably. Such straps can be equipped with Velcro or embedded snaps.

It can also be provided that at least one pocket for receiving tools is provided on two opposite sides of the module carrier. In this way, the space for the tools to be received can be doubled. The clarity and usability are thereby fully retained.

It can be provided that a preferably foldable storage table is provided on the module carrier. The table can be folded in and out so that it does not interfere with the production process at any time. It is used to hold drawings, measuring equipment, etc. and thus allows a variable workplace. The edge of the module can be raised and the surface roughened to allow a secure hold.

It can be provided that a manipulator is provided on the module carrier for handling the tools. With the manipulator (400. FIG. 4), heavy tools can be inserted into or removed from the machine without exertion.

It can be provided that an attachment for tools, preferably adjustable in height, is provided on an upper part of the module carrier. This attachment is used for the temporary storage of tools, for example between two consecutive bending parts. A tool set is then located in the machine for production and the subsequently required set is temporarily stored on this attachment. This means that bending aids, support arms and other add-on parts are free of tools and can be used according to their intended purpose. The attachment can also have a modular structure and can thus be installed or removed. The height of the attachment can also be adjusted to make it easier to insert heavy tools into the clamp. The tools can also be removed with the support of the attachment. This attachment can be geometrically adapted to different tool sizes. The attachment can be attached with a slight inclination in order to fix tools laterally by means of their own weight. In the neutral position, the module is below the bending line, so that there are no impairments when bending. To support a tool change, the entire attachment can be adjusted in the direction of the tool holder. The stored tools then do not have to be lifted that far and the operator is thereby relieved. Such a design can be designed to be automated, for example motorized or else manual, having a pulley system or the like. In addition, the attachment can be designed to be rotatable.

It can also be provided that the module carrier and/or the pocket are designed to be removable. This modular system increases flexibility as module carriers and/or pockets can be prepared or exchanged between machines, for example.

It can be provided that the module carrier has a coupling device designed for fastening to the carriage and the guide rail and/or the pocket has a coupling device designed for fastening to the module carrier and the guide rail. In addition or as an alternative to the fastening of the module carrier and/or the pocket to the carriage, these can also be hung directly on the guide rail. This increases the flexibility in handling. A very modular system is presented that offers a multitude of possible uses.

It can be provided that handles for removing the module carrier are provided on an upper part of the module carrier. The handles are used to remove the module carrier and to be able to separate it from the carriage. The handles are suitable for manual intervention as well as for receiving a forklift fork.

It can be provided that a removable carrier element is provided having at least one pocket for receiving tools, wherein the carrier element has recesses on an upper part designed for fastening the carrier element to the handles of the module carrier. In this way, the carrier element can simply be hung on the handles. The carrier element can just as easily be hung on the machine tool, for example in the guide rail. The entire carrier element, even fully equipped, is removable and can be hung at other points on the machine. There is also a gap between the front wall and the lower beam.

It can be provided that the tool storage unit has a spacer element that can be supported on an end face of the machine tool, preferably in the form of a roller, which runs on the end face of the machine tool. When the tool storage unit is attached to the machine tool, the spacer element ensures that the tool storage unit is aligned vertically. In addition, a stable three-point fastening can be implemented. Moving the tool storage unit is also supported in the form of a roller, the unwinding direction of which runs parallel to the guide rail.

It can also be provided that the tool storage unit is set up to receive a complete tool set for the machine tool and optionally has a compartment for drawings and/or working papers. The tool storage unit can also serve as a means of transport for the tools themselves. The entire tool set can be transported from a tool cabinet to the required machine. Provided there is a corresponding internal process, it is even possible to assign it precisely to an order: The punches and dies required for the production of a bending part, as well as optionally drawings and working papers, are incorporated into the tool storage unit and brought to the machine tool.

It can be provided that the guide rail is a roller guide rail set up to receive machine parts such as support arms and/or bending aids. This already existing guide rail can advantageously be used for holding the tool storage device.

BRIEF SUMMARY OF THE DRAWINGS

The present disclosure will be explained below in exemplary embodiments with reference to the accompanying drawings. In the figures.

DETAILED DESCRIPTION

Figure 1:
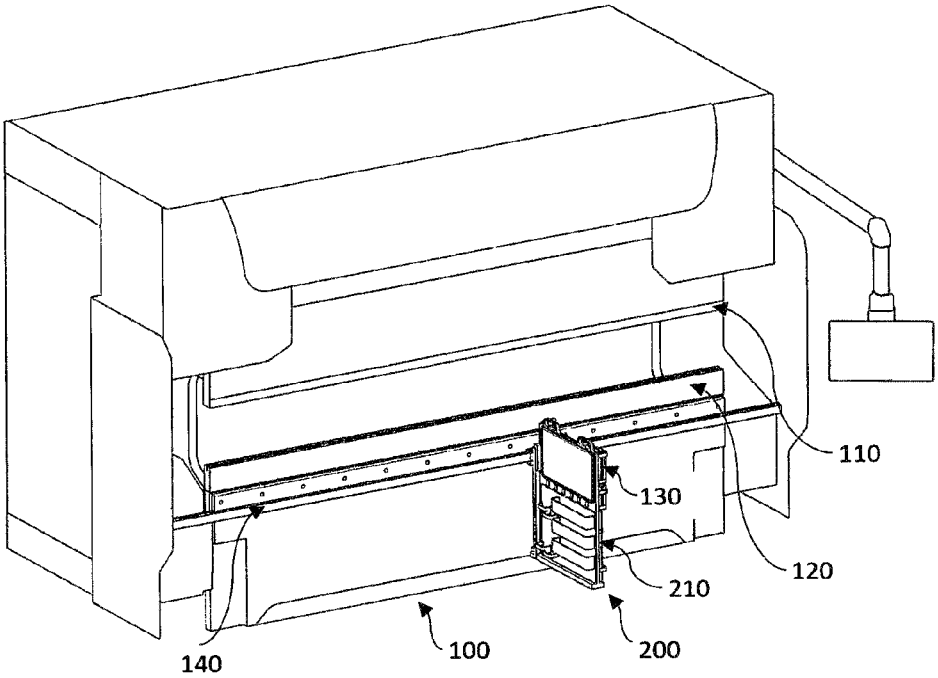
FIG. 1 shows a perspective view of a machine tool having a tool storage device.

FIG. 1 shows a schematic perspective view of a machine tool 100. A machine tool 100 is used to manufacture and machine workpieces using tools. For example, metal or sheet metal working machines, in particular bending machines or presses such as press brakes are considered to be machine tools here.

In a press brake, a bending punch or an upper tool 110 presses a metal sheet into a die or a lower tool 120, which determines the bending angle. In the view of FIG. 1, the reference numeral 120 can also designate a lower tool clamp without a tool. Usually the lower tool 120 has a V-shaped opening and the upper tool 110 has a wedge or a tip. A metal sheet or an often wedge-shaped workpiece is placed between the two tools 110 and 120. If the bending punch is lowered with a certain force, the workpiece is pressed into the opening of the lower tool 120 and bent to the required angle.

A mobile tool storage device 200 is fastened to the machine tool 100. The tool storage device 200 comprises at least one tool storage unit 210 designed to receive non-mounted tools 130 for the machine tool 100. The tool storage unit 210 is removably and displaceably fastened to a guide rail 140 of the machine tool 100.

Figure 2:
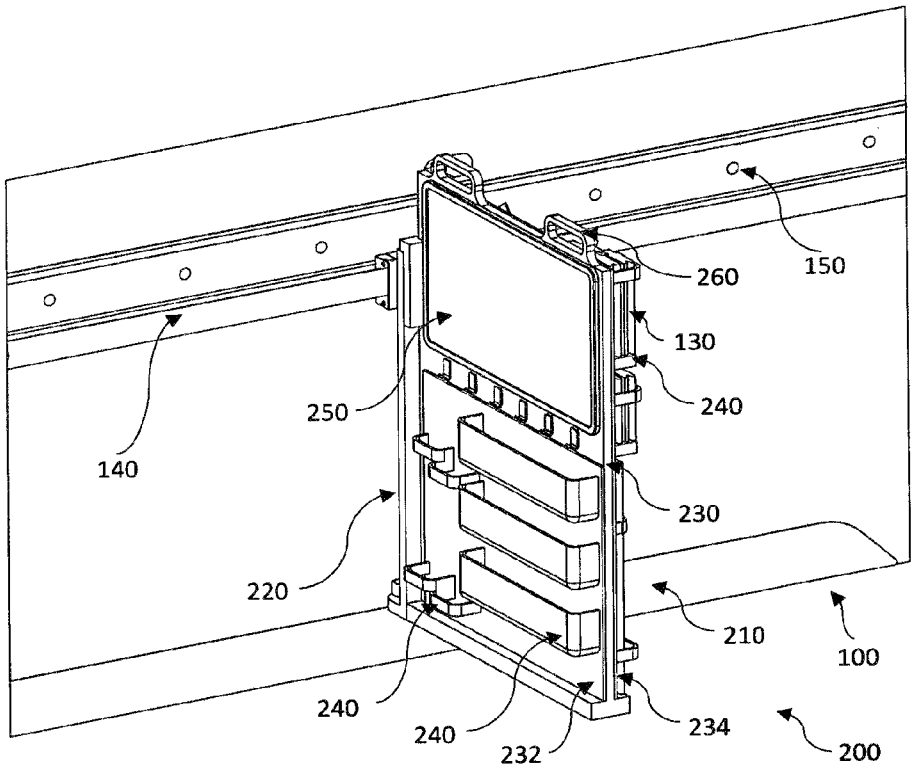
FIG. 2 shows a perspective view of the tool storage device.

FIG. 2 shows a perspective view of a tool storage device 200 having a tool storage unit 210. The tool storage unit 210 can replace a mobile tool trolley, for example.

The tool storage unit 210 is fastened to the guide rail 140 of the machine tool 100 by means of a movable carriage 220. A module carrier 230 is removably arranged on the carriage 220. The module carrier 230 is plate-shaped and is fastened to the carriage 220 on a longitudinal side or longitudinal edge. Correspondingly, two main surfaces 232 and 234 of the module carrier 230 are arranged perpendicular to a front of the machine tool 100 and are therefore easily accessible.

On the module carrier 230 or on its main surfaces, receptacles or pockets 240 for receiving non-mounted tools 130 are attached. The straps or pockets 240 can also be provided only on one side. The pockets 240 can consist of a dimensionally stable material such as plastic or metal and/or a malleable material such as a fabric. The pockets 240 can also serve as receptacles for other add-on parts.

At an upper end of the module carrier 230, for example, a foldable storage table 250 is shown in the folded state. The folding table 250 is described in more detail with reference to FIG. 4. Furthermore, individual hooks for various utensils such as measuring equipment, cleaning rags, etc. are provided on the module carrier 230. The carriage 220 or the module carrier 230 can be designed such that the upper holes 150 in the lower beam of the machine tool 100 can also be used for fastening.

Figure 3:
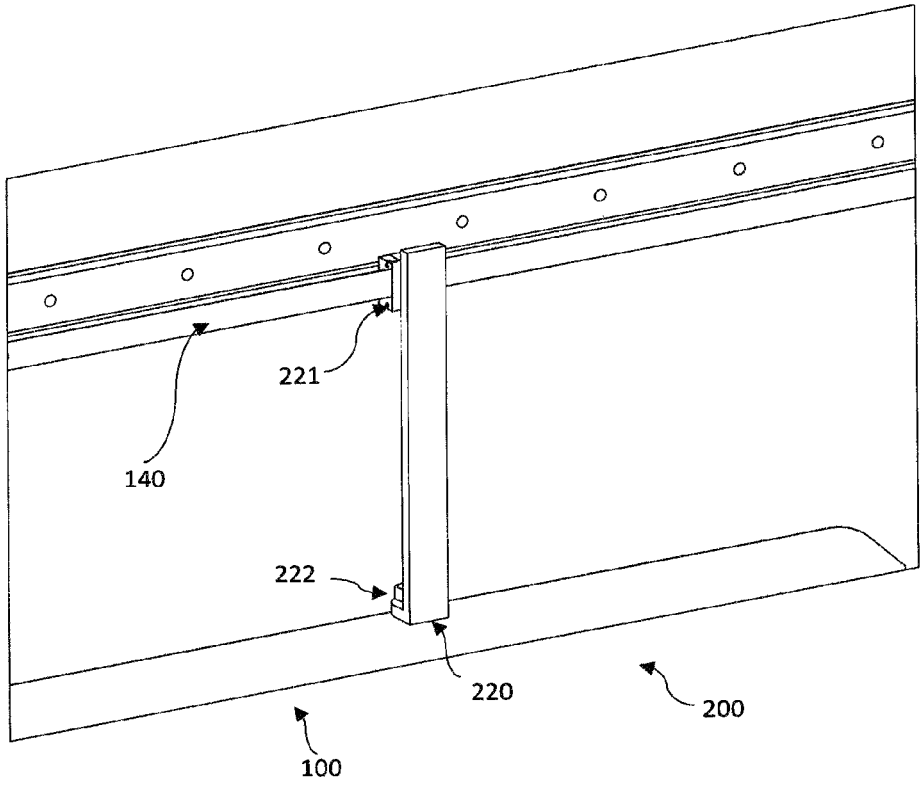
FIG. 3 shows a perspective view of a movable carriage of the tool storage device.

FIG. 3 shows a perspective view of the movable carriage 220 of the tool storage device 200. The carriage 220 is shown here without the module carrier. At an upper end, the carriage 220 comprises a guiding carriage 221 which is fastened to the existing guide rail 140 and can be moved thereon. The guiding carriage 221 can be releasably locked on the guide rail 140 in order to enable an at least temporarily fixed position of the module carrier 230 or the tool storage unit 210. At a lower end, the carriage 220 comprises a lower support or a spacer element 222, for example in the form of a roller, which runs on the end face of the machine tool 100. The spacer element 222 ensures a vertical spacing of the module carrier 230 or the tool storage unit 210 and thus for a vertical alignment of the module carrier 230 or the tool storage unit 210. Finally, the carriage 220 includes a receptacle or interface, not shown here, for fastening the module carrier. This receptacle or fastening is preferably designed to be detachable.

Figure 4:
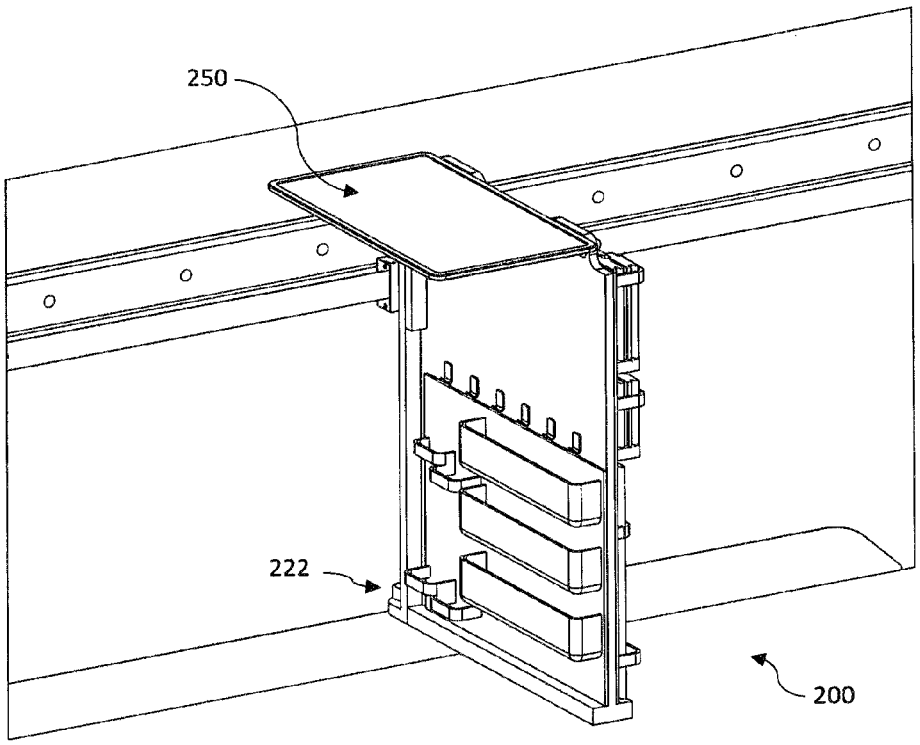
FIG. 4 shows a perspective view of an unfolded table of the tool storage device.

FIG. 4 shows a perspective view of the foldable storage table 250 in the unfolded state. The storage table 250 can also be adjustable in height. Drawings, measuring equipment, writing implements, etc. can be placed on the storage table 250 in order to support work on the machine tool 100.

Figure 5:
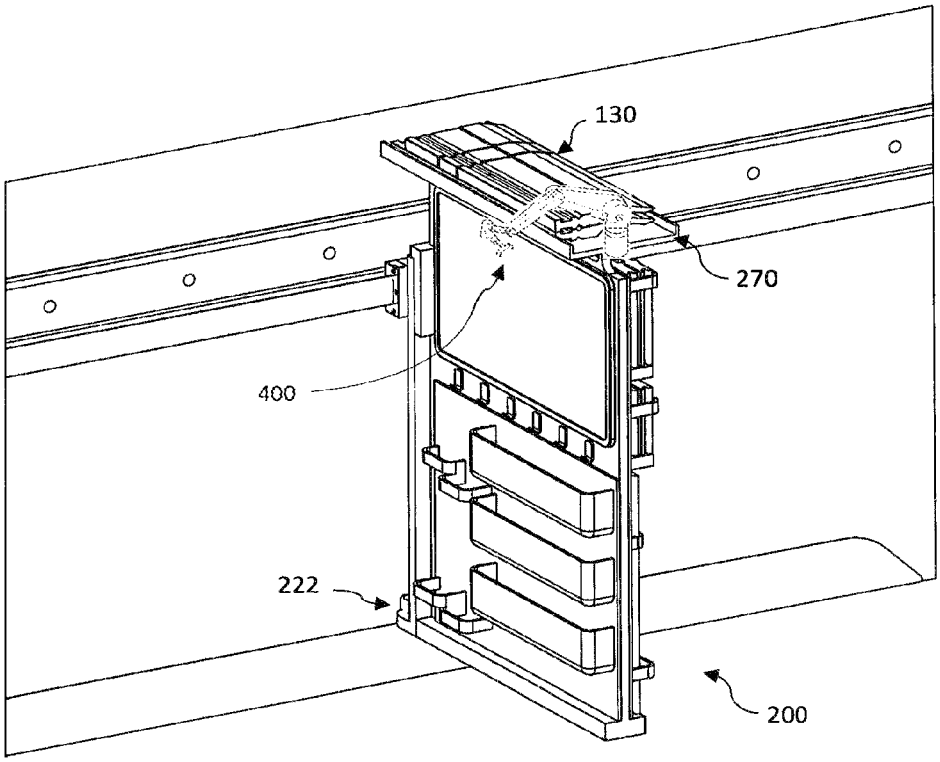
FIG. 5 shows a perspective view of an upper attachment of the tool storage device.

FIG. 5 shows a perspective view of an upper attachment 270 of the tool storage device 200. The attachment 270 is used to receive tools 130. In this example, the tools 130 are punches for assembly in the upper beam. The attachment 270 can be moved in height, for example by means of a motor. Here the attachment 270 is in a lower or lowest position. The attachment 270 can be moved continuously or between an upper position and a lower position. The stacked height of the tools 130, including the attachment 270, is expediently below the bending zone, so that no interfering contours are formed during production.

Figure 6:
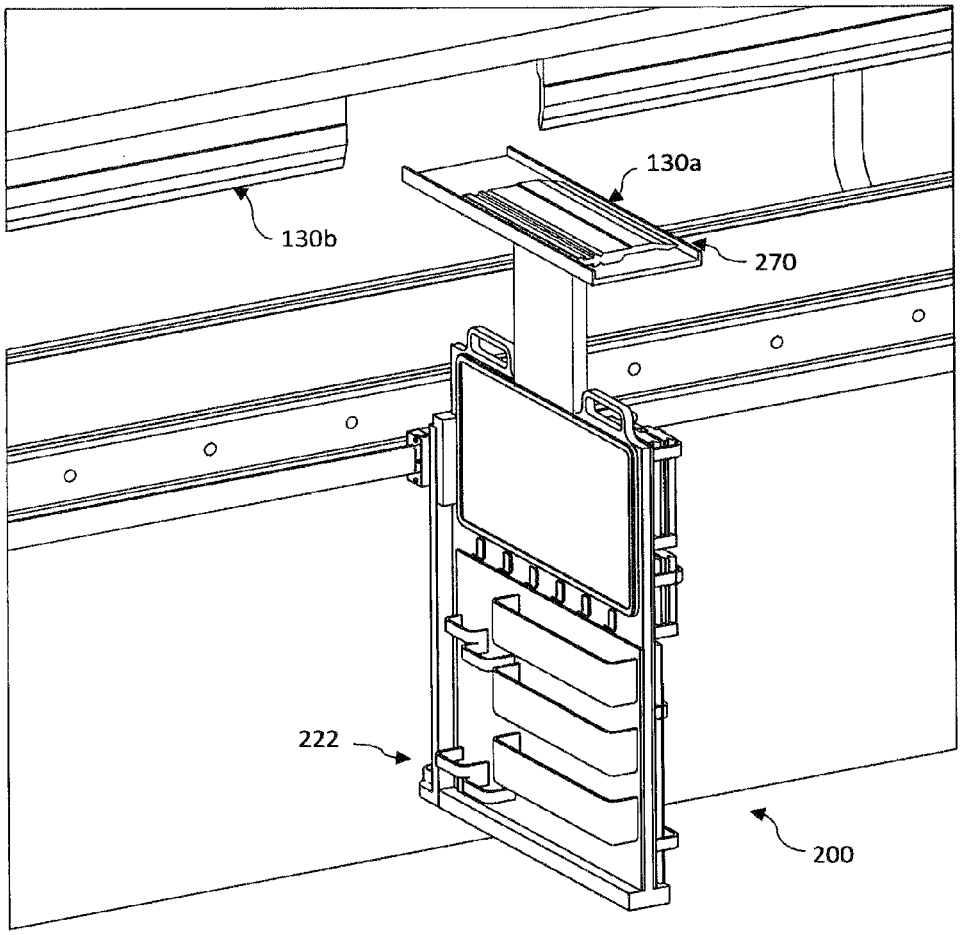
FIG. 6 shows a perspective view of the top attachment in an extended position.

FIG. 6 shows a perspective view of the attachment 270 in an extended position. This upper or uppermost position is suitable for supporting the operating personnel when assembling or disassembling the tools 130. The heavy lifting work can thus be omitted. Here the attachment 270 is shown in the uppermost position with only one tool 130*a*. This missing tool 130*a* has not yet been mounted in the upper beam. The other tools 130*b* have already been removed from the attachment 270 and introduced into the machine tool.

Figure 7:
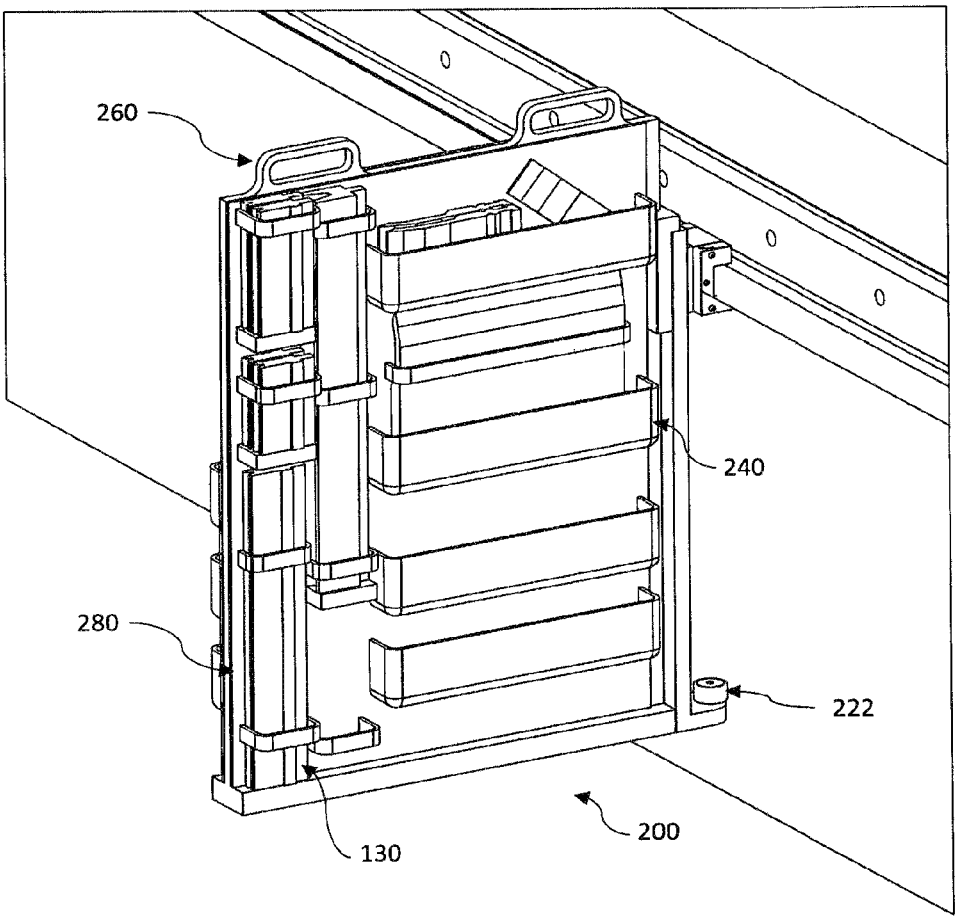
FIG. 7 shows a further perspective view of the tool storage device.

FIG. 7 shows a further perspective view of a tool storage device 200. The module carrier 230 is equipped with pockets 240 which are filled with tools 130 in the form of dies and punches. The pockets 240 are attached to a removable carrier element 280. The carrier element 280 can also be referred to as a tool bag.

The tool bag is hung on the module carrier 230—above the handles 260—and equipped with tools 130. As a result, this carrier element 280 can be handled just as modularly as the module carrier 230 and the carriage and can even be used individually. The carrier element 280 can also be temporarily stored, exchanged transported, provided between machines, etc.

The carrier element 280 can be hung on both sides of the module carrier 230. Both sides of the module carrier 230 can each be equipped with a carrier element 280. The carrier element 280 is provided within this modular system of storage for a longer period of storage. Compared to the attachment, which is only provided for a short interim storage or for the assembly or disassembly of the tools 130, the tools 130 can also be stored in the carrier element 280 until they are needed for the next job, for example.

Figure 8:
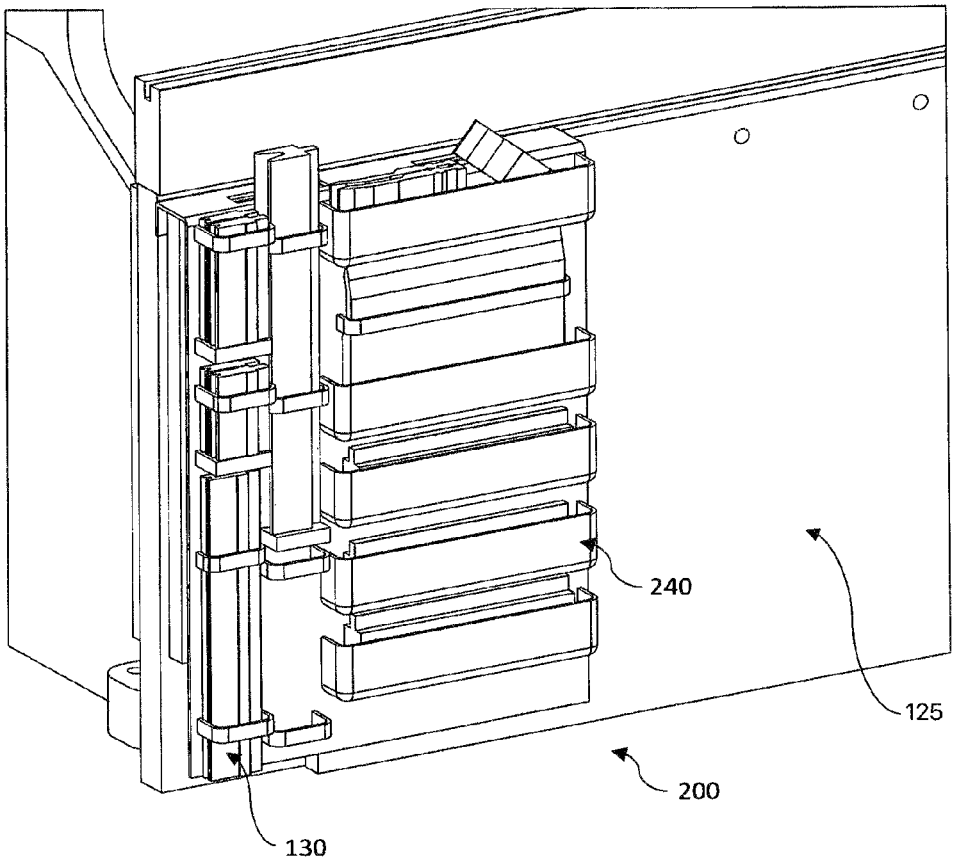
FIG. 8 shows a perspective view of an equipped carrier element of the tool storage device.

FIG. 8 shows a perspective view of an equipped carrier element 280 of the tool storage device 200. In this figure, the carrier element 280 is unhooked and fastened to the lower beam 125 of the machine tool. In the upper area of the carrier element 280, two recesses 290 are provided, which correspond to the handles of the module carrier, so that the carrier element 280 can be simply hung into the module carrier, as shown in FIG. 7.

FIG. 8 shows the individual use of the tool bag or carrier element 280 without module carrier and carriage. Nevertheless, the carrier element 280 can be used on the machine. The carrier element 280 is either fastened to the bores or suspended in the space between the lower beam set, which is shown here. Machines with dynamic crowning have a lower beam set made up of three individual beams. The first intermediate space can represent a fastening option for the carrier element 280. Such a fastening can also take place on machines without a front guide rail and is therefore particularly easy to retrofit.

In addition to the recesses 290, the carrier element 280 can have a U-shaped fastening area 300 with which the carrier element 280 is hung here. One leg of the U-shaped fastening region 300 is formed by the plate of the carrier element 280. A base surface of the fastening region 300, in which the recesses 290 are formed, adjoins the upper edge of this plate. The base surface is at right angles to the plate. The second leg of the fastening area 300 runs parallel to the first leg and adjoins the base.

A second carrier element, not shown here, can be designed without the second leg, so that both carrier elements can be hung together using the handles. The carrier element, not shown here, is then first hung and is arranged on a first side of the module carrier. The carrier element 280 shown here is then hung from the other side over the handles and over the base of the carrier element, not shown here.

FIG. 8 shows the tools 130 being received by pockets 240 which are fastened to the carrier element 280. The carrier element 280 can in turn be fastened to a module carrier or, as shown, directly to the machine, also to the guide rail. Alternatively, a carrier element can be formed without the U-shaped fastening area 300. Such a carrier element is shown in FIG. 7, for example. The attachment to the module carrier is then not carried out using the handles but rather on the plate, for example using hooks or a snap-in connection. Finally, fixed fixations or pockets for tools can also be provided directly on the module carrier. In this case, no carrier element is provided, which is shown in FIG. 6, for example. The different variants can be combined. For example, a variant can be used on one side of the module carrier while another variant is used on the second side of the module carrier.

The tool storage device 200 or machine tool 100 presented here permits simple and secure storage of tools that are not currently required, that is, tools 130 that are not mounted on the machine tool 100. The modular construction of the tool storage device 200 allows great flexibility not only in the storage of the tools 130 on the machine tool 100 but also in the provision of the tools 130 for an order and in the storage of the tools 130.

The invention claimed is:

1. A press brake having a front and a lower beam defining an area of the front, the press brake comprising:

a receptacle configured to receive a press brake tool configured to be operated by the press brake, a guide rail, at least one press brake tool storage device having a tool storage unit configured to be both displaceable and mountable on the guide rail and further configured to receive at least one of the press brake tool, wherein the guide rail is arranged within the lower beam, and wherein the tool storage unit comprises a carriage configured to be moved on the guide rail and a module carrier arranged on the carriage and configured to receive the press brake tools.

2. The press brake according to claim 1, wherein the tool storage unit comprises a carriage configured to be moved on the guide rail and a module carrier arranged on the carriage and configured to receive the press brake tools.

3. The press brake according to claim 2, further comprising at least one pocket configured to receive the press brake tools and arranged on the module carrier.

4. The press brake according to claim 2, further comprising at least one pocket configured to receive the press brake tools and arranged on opposite sides of the module carrier.

5. The press brake according to claim 2, further comprising at least one of a foldable and an upper attachment arranged on the module carrier.

6. The press brake according to claim 2, further comprising a manipulator configured to handle the press brake tools and arranged on the module carrier.

7. The press brake according to claim 2, further comprising at least one of an attachment and a height adjustable attachment for the press brake tools arranged on an upper part of the module carrier.

8. The press brake according to claim 2, further comprising a pocket and wherein at least one of the module carrier and the pocket is removable.

9. The press brake according to claim 8, wherein the module carrier comprises a coupling device configured to attach to the carriage and at least one of the guide rail and the pocket comprises a coupling device configured to fasten to the module carrier and the guide rail.

10. The press brake according to claim 2, further comprising handles configured to remove the module carrier and arranged on an upper part of the module carrier.

11. The press brake according to claim 10, further comprising a removable carrier element having at least one pocket configured to receive tools, wherein the carrier element further comprises recesses on an upper part configured to fasten the carrier element to the handles of the module carrier.

12. The press brake according to claim 2, wherein the tool storage unit comprises a spacer element configured to be at least one of supported on an end face of the machine tool and have a form of a roller which runs on the end face of the press brake tool.

13. The press brake according to claim 1, wherein the tool storage unit is at least one of configured to receive a complete tool set for the press brake tool and further comprises a compartment for receiving at least one of drawings and working papers.

14. The press brake according to claim 1, wherein the guide rail is a roller guide rail configured to receive machine parts including at least one of support arms and bending aids.

* * * * *